US005826150A

United States Patent [19]

Folkins

[11] Patent Number: 5,826,150

[45] Date of Patent: Oct. 20, 1998

[54] INTEGRATED MULTI-TONER DISPENSING SYSTEM

[75] Inventor: Jeffrey J. Folkins, Rochester, N.Y.

[73] Assignee: Xerox Corporation, Stamford, Conn.

[21] Appl. No.: 892,218

[22] Filed: Jul. 14, 1997

[51] Int. Cl.[6] ..... G03G 15/08

[52] U.S. Cl. ..... 399/260; 399/256

[58] Field of Search ..... 399/258, 260, 399/262, 223, 224, 228, 263, 256

[56] References Cited

U.S. PATENT DOCUMENTS

| | | | |
|---|---|---|---|
| 3,955,530 | 5/1976 | Knechtel | 399/318 X |
| 4,928,144 | 5/1990 | Kasahara et al. | 399/228 |
| 5,045,884 | 9/1991 | Ohira et al. | 399/224 |
| 5,250,993 | 10/1993 | Seyfried et al. | 399/105 |
| 5,402,222 | 3/1995 | Haneda et al. | 399/223 |
| 5,442,423 | 8/1995 | Edmunds et al. | 399/262 |
| 5,541,720 | 7/1996 | Haneda | 399/228 |
| 5,557,381 | 9/1996 | Sakamoto et al. | 399/262 X |
| 5,585,899 | 12/1996 | Palumbo et al. | 399/258 X |

*Primary Examiner*—S. Lee

[57] ABSTRACT

A color printing machine with a plurality of toner dispensers has a fewer number of toner dispenser members and control mechanisms than toner dispensers. This is accomplished by locating the toner dispensers in close proximity to one another so that a single toner dispenser member can extend between the plurality of toner dispensers. Various toner dispenser members such as a toner moving member, a toner mixing member and a gating member can be used alone or in combination to aid in dispensing the toner from the toner dispenser. When the toner dispenser member extends through the walls of the toner dispensers, seals must be formed between the toner dispenser member and the toner dispenser walls in order to contain the toner therein.

18 Claims, 5 Drawing Sheets

INTEGRATED MULTI-TONER DISPENSING SYSTEM

This invention relates generally to a method and apparatus for dispensing toner in an electrophotographic machine and more particularly concerns integrating the functions of a plurality of toner dispensing mechanisms in order to reduce the number and complexity of toner dispensing mechanisms.

In the low volume/desktop printing market, low cost, small size and simplicity of design are critical requirements. With the introduction of color printing machines, a plurality of developing stations are necessary, a developing station being associated with each color to be developed. Currently, each developing station includes separate toner dispensing systems each having auger, mixer and gate mechanisms associated therewith to control the amount of toner dispensed to the respective developer units. It is highly desirable to reduce the number of redundant control mechanisms in order to reduce the cost and complexity of color printing machines.

The following disclosures may be relevant to various aspects of the present invention:

U.S. Pat. No. 3,955,530 Inventor: Knechtel Issued: May 11, 1976

U.S. Pat. No 5,250,993 Inventor: Seyfried et al. Issued: Oct. 5,1993

U.S. Pat. No. 5,402,222 Inventor: Haneda et al. Issued: Mar. 28, 1995

U.S. Pat. No. 5,442,423 Inventor: Edmunds et al. Issued: Aug. 15, 1995

U.S. Pat. No. 5,541,720 Inventor: Haneda Issued: Jul. 30, 1996

Some relevant portions of the foregoing disclosures may be briefly summarized as follows:

U.S. Pat. No. 3,955,530 discloses an electrophotographic apparatus having a developing device with a plurality of developing units, each developing unit containing a different color of developing material. The developing units are attached to one another and move together as a unit so that the appropriate color of developing material develops the latent image.

U.S. Pat. No 5,230,993 teaches an apparatus for supplying toner material to a developer unit in an electrophotographic system that is mounted within a drawer and pivotable within the drawer about a longitudinal axis. A conduit between the toner dispenser and the developer unit is open in the operative position and is sealed when the developer unit is in the service position.

U.S. Pat. No 5,402,222 discloses a color image forming apparatus which has developing units disposed along a photoreceptor, the developing unit housings being attached to one another. The photoreceptor may be a drum or a belt which can be oriented in the horizontal or vertical direction. The developing units remain in a fixed position as the photoreceptor brings the latent image to be developed to the developing units.

U.S. Pat. No. 5,442,423 discloses a developer unit with a chamber having a supply of toner therein. A toner moving member in the form of an auger projects through the chamber wall, the wall including a bearing which also acts to seal the chamber in order to contain the toner. Several different seals are shown.

U.S. Pat. No. 5,541,720 teaches a color image forming apparatus with developer units which are integrally formed and arranged in a detachable module. The developer units include a toner hopper and developing means which deliver the appropriate color of toner to a latent image formed on a photoreceptor. The detachable module can be completely detached from the electrophotographic machine when the developer is to be replenished.

All of the above references are hereby incorporated by reference.

SUMMARY OF THE INVENTION

One aspect of the invention is drawn to an apparatus for dispensing toner having at least two toner dispensers, each toner dispenser having a supply of toner contained therein and an opening through which toner passes from the toner dispenser. A toner dispenser member is associated with the toner dispensers, the toner dispenser member having at least two toner dispenser sections, each toner dispenser section having a toner dispenser associated therewith. A toner dispenser member control controls the movement of the toner dispenser member, so that the toner dispenser member sections cause the toner in the toner dispenser to move when the toner dispenser member control is actuated.

Another aspect of the invention is drawn a method for dispensing toner including locating at least two toner dispensers in close proximity to one another, each toner dispenser having a supply of toner contained therein and an opening through which toner passes from the toner dispenser and dispensing toner from the at least two toner dispensers with a toner dispenser member having at least two toner dispenser sections, each toner dispenser section having a toner dispenser associated therewith. The toner dispensing is controlled with a toner dispenser member control so that the toner dispenser member sections cause the toner to move when the toner dispenser member control is actuated.

Yet another aspect of the invention is drawn to a method for dispensing toner including locating at least two toner dispensers in close proximity to one another, each toner dispenser having a supply of toner contained therein and an opening through which toner passes from the toner dispenser and providing a toner dispenser member which extends between the toner dispensers having at least two toner dispenser sections, each toner dispenser section having a toner dispenser associated therewith. Toner is dispensed from the toner dispensers with the toner dispenser member by mixing toner in the dispenser, moving toner in the dispenser towards the opening and gating the flow of toner from the dispenser. The toner dispensing is controlled with a toner dispenser member control sot that the toner dispenser member sections cause the toner to move when the toner dispenser member control is actuated.

The present invention is drawn to reducing the number of toner dispenser control mechanisms in a color printing machine having a plurality of toner dispensers. This is accomplished by locating the toner dispensers along a relatively straight line so that a single toner dispenser member with a single control mechanism can move toner from the toner supply to the developer units. Various toner dispenser members such as a toner moving member, a toner mixing member and a gating member can be used alone or in combination to aid in dispensing the toner from the toner dispenser.

BRIEF DESCRIPTION OF THE DRAWINGS

Other features of the present invention will become apparent as the following description proceeds and upon reference to the drawings, in which.

DETAILED DESCRIPTION OF THE INVENTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

The present invention is practiced in an electrophotographic or printing machine. The embodiment shown in FIG. 1 includes a plurality of individual subsystems which are organized and used so as to produce a color image in 5 cycles, or passes, of a photoconductive member. While the 5 cycle color electrophotographic architecture results in a 20% loss of productivity over a comparable 4 cycle color electrophotographic architecture, the additional cycle allows for a significant size and cost reduction. Of course, the present invention can also be used in more conventional electrophotographic architectures such as 4 pass systems.

Figure 1:
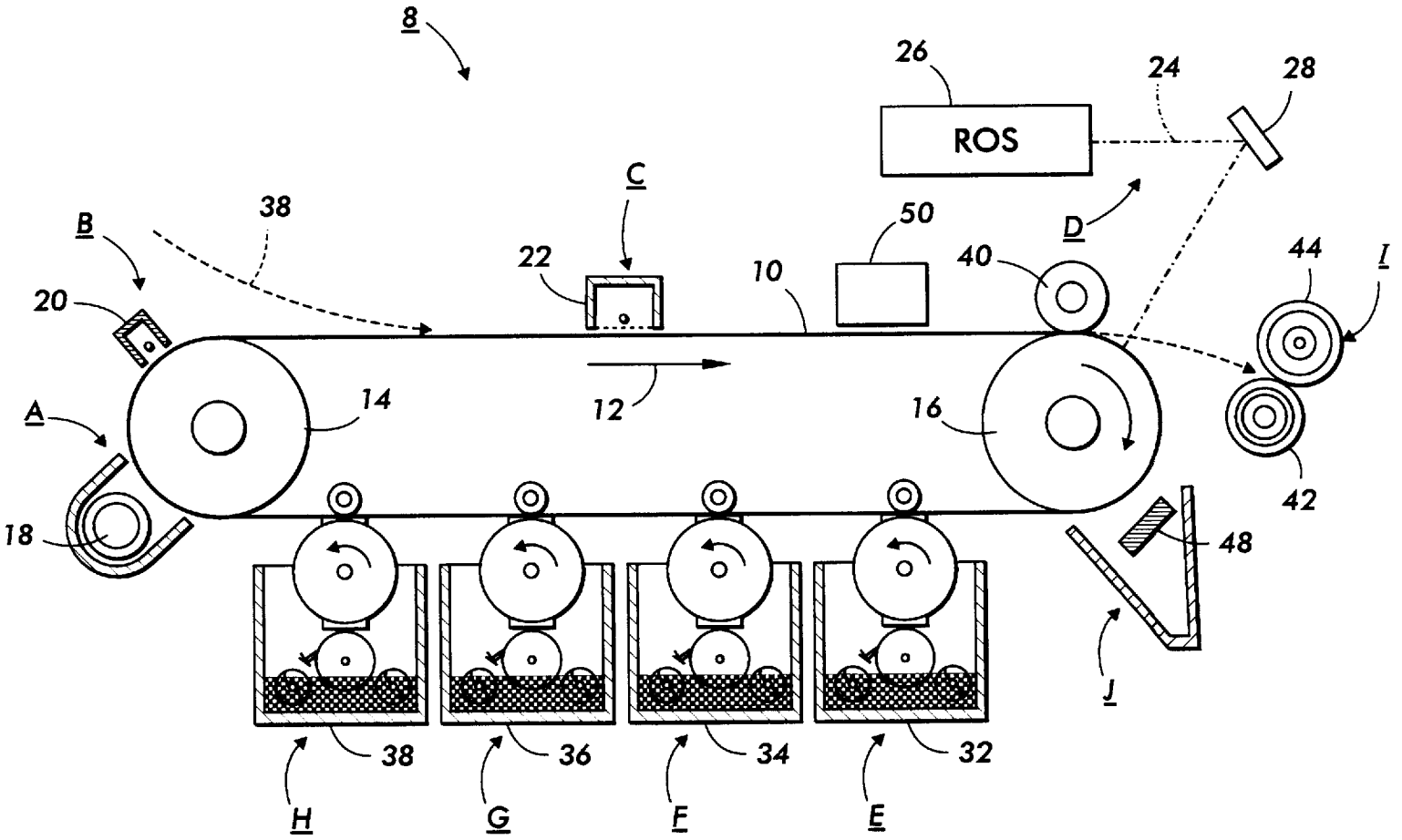
FIG. 1 is a schematic view of an electrophotographic print engine.

FIG. 1 illustrates a color electrophotographic printing machine 8 which is suitable for implementing the principles of the present invention. The printing machine 8 includes a photoreceptor belt 10 which travels in the direction indicated by the arrow 12. Belt travel is brought about by mounting the belt about a drive roller 16 (which is driven by a motor which is not shown) and a tension roller 14.

As the photoreceptor belt travels each part of it passes through each of the subsequently described process stations. For convenience, a single section of the photoreceptor belt, referred to as the image area, is identified. The image area is that part of the photoreceptor belt which is to receive the toner images which, after being transferred to a substrate, produce the final color image. While the photoreceptor belt may have numerous image areas, since each image area is processed in the same way a description of the processing of one image area suffices to fully explain the operation of the printing machine.

As previously mentioned, the production of a complete color print takes place in 5 cycles. The first cycle begins with the image area passing through an erase station A. At the erase station an erase lamp 18 illuminates the image area so as to cause any residual charge which exist on the image area to be discharged. Such erase lamps and their use in erase stations are well known. Light emitting diodes are commonly used as erase lamps.

As the photoreceptor belt continues its travel the image area passes through a first charging station B. At the first charging station B a corona generating device 20, charges the image area to a relatively high and substantially uniform potential of, for example, about −700 volts. After passing the corona generating device 20 the image area passes through a second charging station C which partially discharges the image area to about, for example −500 volts. The second charging station C includes an AC scorotron 22.

The use of a first charging station to overcharge the image area and a subsequent second charging station to neutralize the overcharge is referred to as split charging. Since split charging is beneficial for recharging a photoreceptor which already has a developed toner layer, and since the image area does not have such a toner layer during the first cycle, split charging is not required during the first cycle. If split charging is not used either the corona generating device 20 or the scorotron 22 corona could be used to simply charge the image area to the desired level of −500 volts.

After passing through the second charging station C the now charged image area passes through an exposure station D. At the exposure station D the charged image area is exposed to the output 24 of a laser based output scanning device 26 and which reflects from a mirror 28. During the first cycle the output 24 illuminates the image area with a light representation of a first color (say black) image. That light representation discharges some parts of the image area so as to create an electrostatic latent image. For example, illuminated sections of the image area might be discharged by the output 24 to about −50 volts. Thus after exposure the image area has a voltage profile comprised of relatively high voltages of about −500 volts and of relatively low voltages of about −50 volts.

After passing through the exposure station D the exposed image area passes through a first development station E which deposits a first color of negatively charged toner 32, preferably black, onto the image area. Toner adhering to the image area is charged This causes the voltage in the illuminated area to increase by about −200 volts. Thus after development the toned parts of the image area are charged to about −250 volts while the untoned parts are charged to about −500 volts.

The developer stations could be magnetic brush developer stations, however they are preferably scavengeless developers. A benefit of scavengeless development is that it does not disturb previously developed toner layers.

After passing through the first development station E, the image area advances so as to return to the first charging station B. The second cycle begins. The first charging station B uses its corona generating device 20 to overcharge the image area and its first toner layer to more negative voltage levels than that which the image area and its first toner layer are to have when they are exposed. For example, the untoned parts of the image area may be charged to a potential of about −700 volts.

The voltage differences between the toned and untoned parts of the image area are substantially reduced at the second charging station C. There the AC scorotron 22 reduces the negative charge on the image area by applying positive ions so as to charge the image area to about −500 volts.

After passing through the second charging station C the now substantially uniformly charged image area with its first toner layer advances to the exposure station D. At the exposure station D the recharged image area is again exposed to the output 24 of a laser based output scanning device 26. During this pass the scanning device 26 illuminates the image area with a light representation of a second color (say yellow) image. That light representation discharges some parts of the image area so as to create a second electrostatic latent image. The potentials on the image area after it passes through the exposure station D the second time have a potential about −500. However, the illuminated areas, both the previously toned areas and the untoned areas are discharged to about −50 volts.

After passing through the exposure station D the now exposed image area passes through a second development station F which deposits a second color of toner 34, yellow, onto the image area. The second development station F preferably is a scavengeless developer.

After passing through the second development station F the image area and its two toner layers returns to the first charging station B. The third cycle begins. The first charging station B again uses its corona generating device 20 to overcharge the image area and its two toner layers to more negative voltage levels than that which the image area and its two toner layer are to have when they are exposed. The second charging station C again reduces the image area potentials to about −500 volts. The substantially uniformly charged image area with its two toner layers then advances again to the exposure station D. At exposure station D the image area is again exposed to the output 24 of the laser based output scanning device 26. During this pass the scanning device 26 illuminates the image area with a light representation of a third color (say magenta) image. That light representation discharges some parts of the image area so as to create a third electrostatic latent image.

After passing through the exposure station D the third time the image area passes through a third development station G. The third development station G, preferably a scavengeless developer, advances a third color of toner 36, magenta, onto the image area. The result is a third toner layer on the image area.

The image area with its three toner layers then advances back to the charging station B. The fourth cycle begins. The first charging station B once again uses its corona generating device 20 to overcharge the image area (and its three toner layers) to more negative voltage levels than that which the image area is to have when it is exposed (say about −500 volts). The second charging station C once again reduces the image area potentials to about −500 volts. The substantially uniformly charged image area with its three toner layers then advances yet again to the exposure station D. At the exposure station D the recharged image area is again exposed to the output 24 of the laser based output scanning device 26. During this pass the scanning device 26 illuminates the image area with a light representation of a fourth color (say cyan) image. That light representation discharges some parts of the image area so as to create a fourth electrostatic latent image.

After passing through the exposure station D the fourth time the image area passes through a fourth development station H. The fourth development station, also a scavengeless developer, advances a fourth color of toner 38, cyan, onto the image area. This marks the end of the fourth cycle.

After completing the fourth cycle the image area has four toner powder images which make up a composite color powder image. The fifth cycle begins with the image area passing the erase station A. At erase station A the erase lamp 18 discharges the image area to a relatively low voltage level. The image area with its composite color powder image then passes to the charging station B. During the fifth cycle the charging station B acts like a pre-transfer charging device by spraying the image area with negative ions. As the image area continues in its travel a substrate 38 is advanced into place over the image area using a sheet feeder (which is not shown). As the image area and substrate continue their travel they pass through station C.

At station C positive ions are applied by the scorotron 22 onto one side of the substrate 38. This attracts the charged toner particles from the image area onto the substrate. As the substrate continues its travel the substrate passes a bias transfer roll 40 which assists in separating the substrate and the composite color powder image from the photoreceptor belt 10. The substrate is then directed into a fuser station I where a heated fuser roll 42 and a heated pressure roller 44 create a nip through which the substrate passes. The combination of pressure and heat at the nip causes the composite color toner image to fuse into the substrate 38. After fusing a chute, not shown, guides the support sheets 38 to a catch tray, also not shown, for removal by an operator.

After the substrate is pulled off the photoreceptor belt 10 by the bias transfer roll 40 the image area continues its travel and eventually enters a cleaning station J. At cleaning station J a cleaning blade 48 is brought into contact with the image area. The cleaning blade wipes residual toner particles from the image area. The image area then passes once again to the erase station A and the 5 cycle printing process begins again.

The various machine functions described above are generally managed and regulated by a controller which provides electrical command signals for controlling the operations described above. The controller must have information from the printing process parameters in order to accurately control the printing process.

Figure 2:
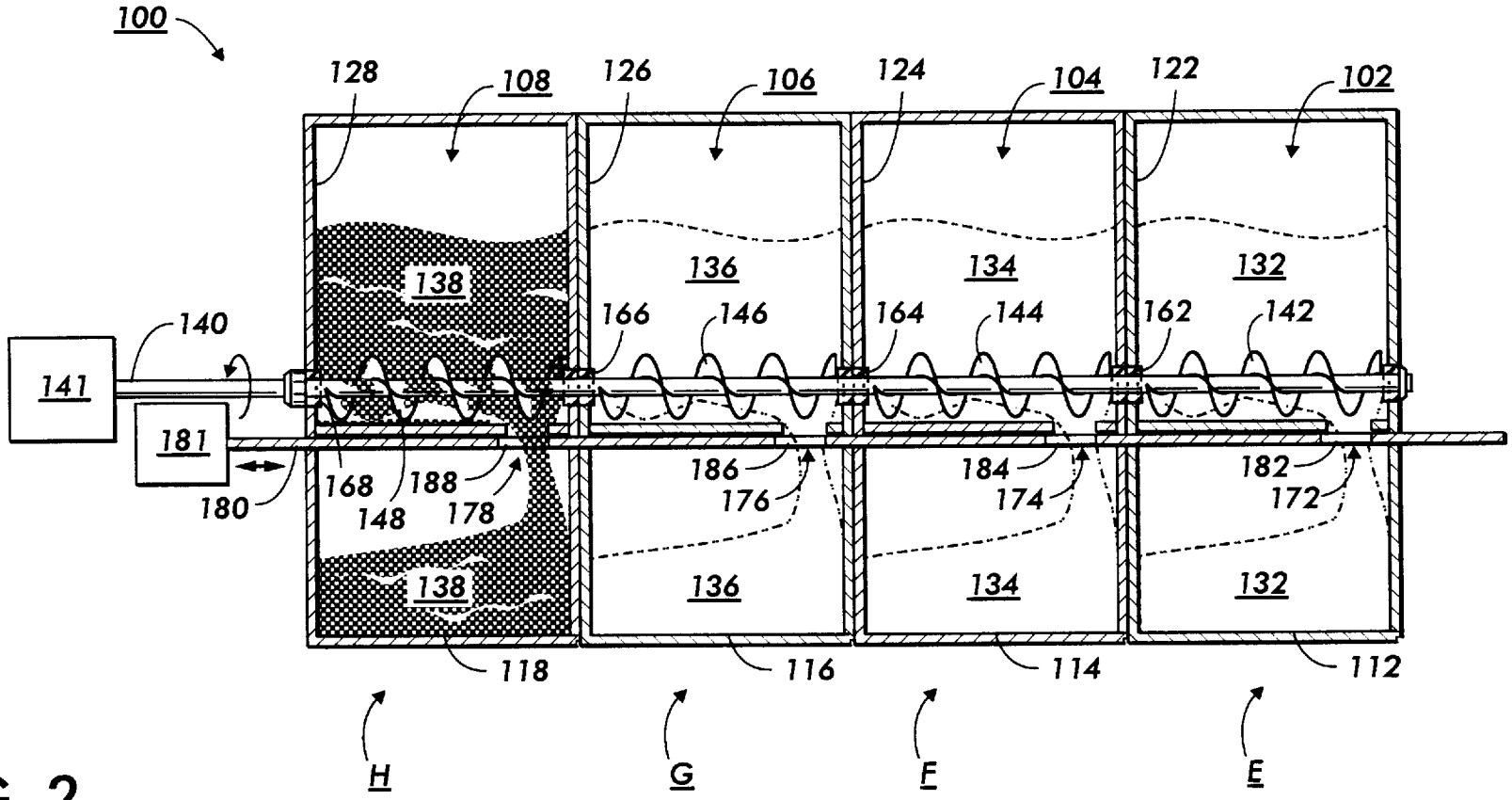
FIG. 2 is a schematic view of the integrated developer dispenser of the present invention.

FIG. 2 shows multiple color toner dispensers and developer units constructed in an integrated in-line developer module 100. Development stations E, F, G and H are part of developer module 100 and are shown as being an integrated unit, however development stations E, F, G and H may be separate, closely spaced units. Each development station has a toner dispenser, 102, 104, 106 and 108. Toner dispensers 102, 104, 106 and 108 are respectively associated with developer units 112, 114, 116 and 118. Common walls 122, 124, 126 and 128 separate the toner dispensers from one another. Each toner dispenser and developer unit contain different colors of toner, 132 being black toner, 134 being cyan toner, 136 being magenta toner and 138 being yellow toner.

In a preferred embodiment, toner dispensers 102, 104, 106 and 108 are located directly above developer units 112, 114, 116 and 118. As can be appreciated, the toner dispensers may be located anywhere within the electrophotographic machine, however additional toner moving mechanisms will be needed to move the toner from the toner dispensers to the developer units. In the configuration shown, toner from the toner dispensers is mostly gravity fed into the developer units. Only a mixer and/or simple augering is required at the bottom of the toner supply.

The function of the toner dispensers is to deliver toner to the developer units and to ensure that the developer material is properly mixed. Several different types of toner dispenser members will be discussed including toner moving, mixing and gating members. Toner moving member 140, shown here in the form of an auger, is controlled by toner moving control mechanism 141. The housing alignment substantial along one line enables more than two housings to share dispensing mechanisms. Toner moving member passes through walls 122, 124, 126 and 128 of the toner dispensers. Toner moving member 140 has toner moving sections 142, 144, 146 and 148 in each of the toner dispensers, all of the toner moving sections rotate when toner moving member 140 is actuated.

Dispenser wall channels with seals 162, 164, 166 and 168 allow toner moving member 140 to pass through dispenser walls 122, 124, 126 and 128. The seals surrounding toner moving member 140 may be any type of seal capable of containing the toner within each toner dispenser such as mechanical wipers or magnetic seals. Toner moving member 140 can be configured to mix, as well as move the toner.

Toner moving member sections 142, 144, 146 and 148 move toner in the toner dispensers to dispenser openings 172, 174, 176 and 178. This is accomplished by rotating auger 140 in the direction shown by the arrow. The mixing portion of the auger could be made as invasive or active as needed to the point of performing a thumper function. Of course the toner mixing and moving operations may be performed by two different members rather than the combined mixing/moving member shown.

Gating member 180 controls the flow of toner from the toner dispensers to the developing units. Gating member 180 is controlled by gating member controller 181. The individual gating functions of the toner dispenser can be accomplished with mechanical means using degrees of motion fewer than the number of gates to be controlled. For example, where there are n number of developer units there will be n−1 or less gate controllers. Gating member 180 is shown in the form of a plate with gating member openings 182, 184, 186 and 188, however any equivalent gating member could be used. When the gating member openings are aligned with toner dispenser openings 172, 174, 176 and 178, toner will fall from the toner dispenser units into the developer units. Gate 180 travels back and forth depending upon the actuation of the developer units. When gating member 180 is actuated, the gate is in the open position and gating member 180 is deactivated, the gate moves to the closed position to block the movement of the toner from the toner dispensers to the developer units. It is also possible to combine the gating and mixing/transport mechanical mechanisms because the same movement which opens the gates could provide some mixing/disturbance and/or movement/augering.

Figure 3:
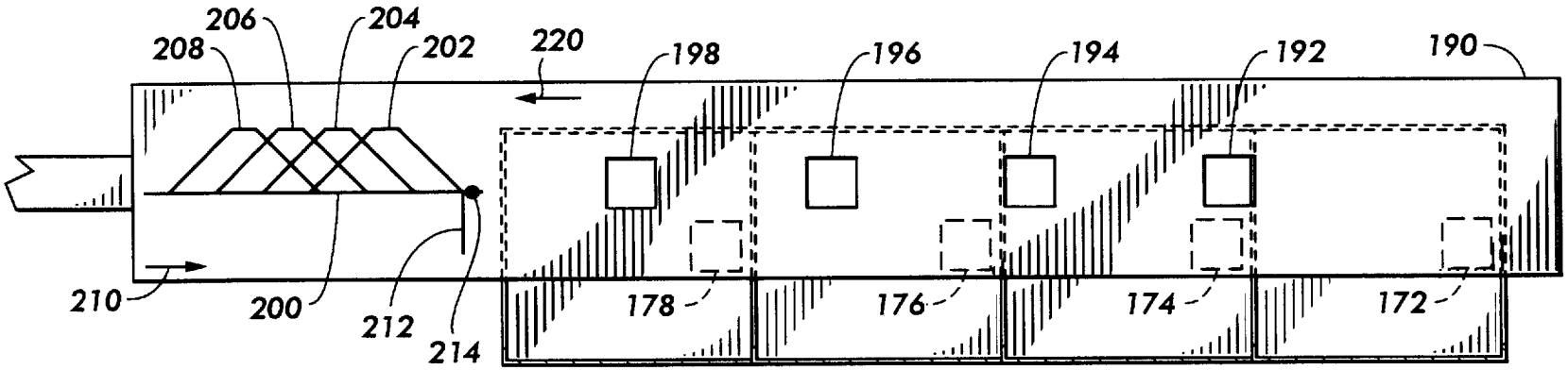
FIG. 3 is a schematic view of a particular gating member.

FIG. 3 shows a slightly more complex gating member 190 which allows certain colors to be skipped, depending upon the color of toner used to develop the latent images by the developer units. This gating system will more precisely control the amount of toner delivered to the developer units. The toner channel gating can be performed with the gate 190 run along a track 200 with gate control 191 in the form of a single linear drive control mechanism and fixed gate pin 214. Gate 190 is run in the direction of arrow 210 for a time/distance corresponding to the toner color to be gated. Reversing the direction, shown by arrow 220, allows the plate to move on a track slightly sideways so that gating member openings 192, 194, 196 and 198 are selectively aligned with the corresponding toner dispenser opening, track 202 corresponding to gating member opening 192, track 204 corresponding to gating member opening 194, track 206 corresponding to gating member opening 196 and track 208 corresponding to gating member opening 198. Continued motion in the direction of arrow 220 returns the plate to the zero position. Hence a simple timed forward and backward motion can selectively control the dispensing of four colors in the developing process. One example of the control mechanism is a timed rotating screw that can alternatively select one of four positions followed by a second mechanical movement to open the gate.

Figure 4:
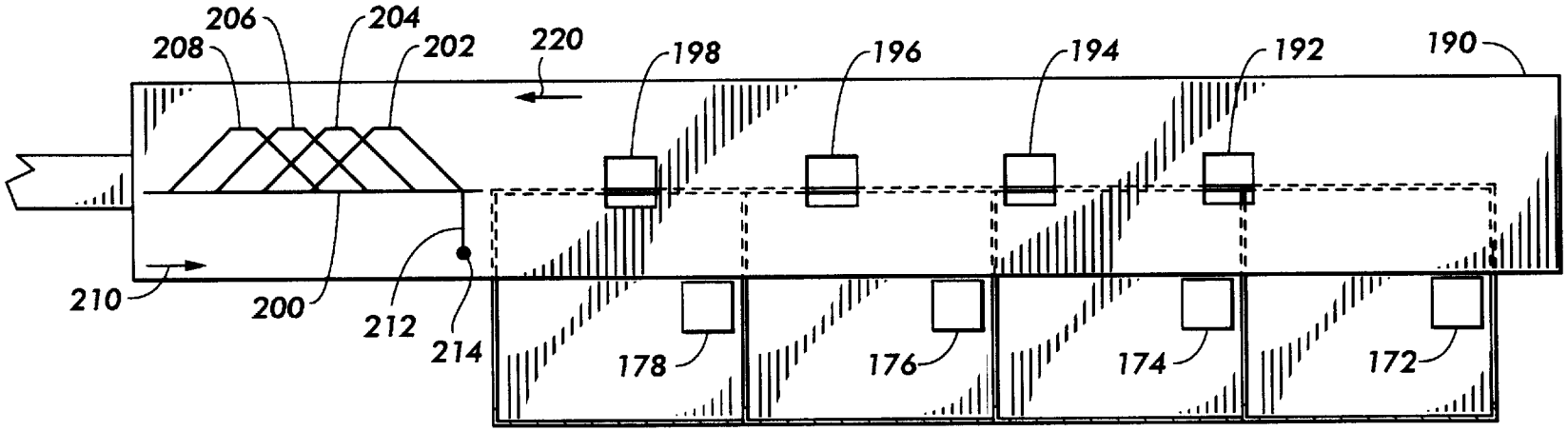
FIG. 4 is a view of the gating member in the full open position.

Perpendicular track member 212 allows gating member 190 to move in an additional direction as shown in FIG. 4. Movement along perpendicular track member 212 away from track 200 allows all of the toner dispenser openings 172, 174, 176 and 178 to open.

Figure 5:
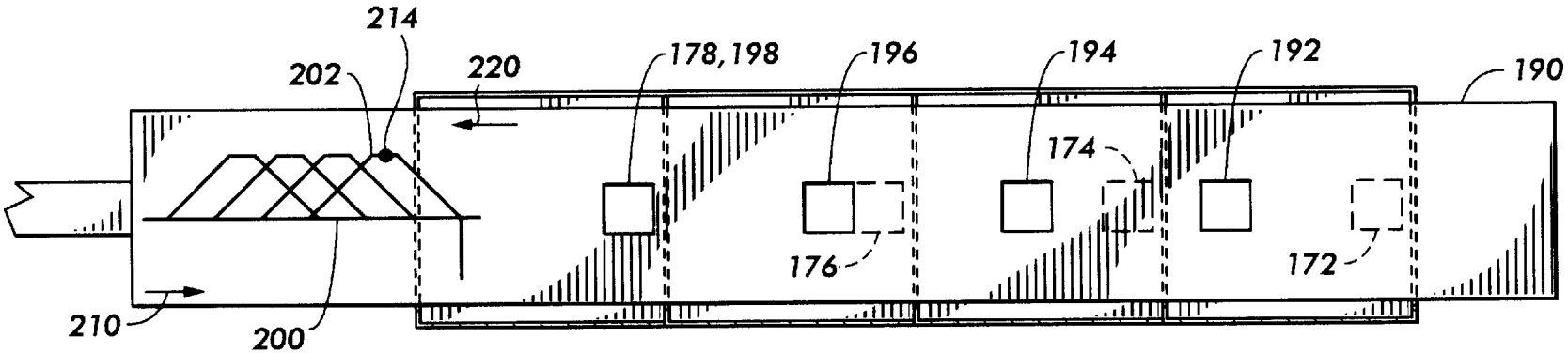
FIG. 5 is a view of the gating member in the selectively open position.

FIG. 5 shows alignment of toner dispenser opening 178 and gate member opening 198 so that toner is dispensed from toner dispenser 108. Toner dispenser openings 172, 174 and 176 are blocked by gating member 190.

Another advantage of the integrated module is that when the entire toner supply is included, a recyclable customer replaceable unit (RCRU) is easily obtained. Bundling the toner supplies with the xerographic RCRU would have extremely beneficial unit manufacturing costs. Also, the toner dispenser unit could be removable from the developing units and only the dispenser module could be sent for refilling. Each of these toner dispensing systems have fewer control mechanisms to detach from the machine which would make these systems much simpler to remove than current removable systems.

It is, therefore, apparent that there has been provided in accordance with the present invention, an integrated multi-toner dispenser that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

I claim:

1. An apparatus for dispensing toner, comprising:

at least two toner dispensers, each toner dispenser having a supply of toner contained therein and an opening through which toner passes from the toner dispenser;

a toner dispenser member associated with the toner dispensers, the toner dispenser member having at least two toner dispenser sections, each toner dispenser section having a toner dispenser associated therewith and the toner dispenser member is a toner moving member extending between the toner dispensers which moves toner in each toner dispenser towards the opening through which toner passes from the toner dispenser; and a toner dispenser member control for controlling movement of the toner dispenser member.

2. The apparatus as claimed in claim 1, wherein the toner dispensers are integrally formed such that each toner dispenser shares a common wall with another toner dispenser.

3. The apparatus as claimed in claim 2, further comprising:

toner dispenser seals surrounding portions of the toner dispenser member which extend through the common walls between the toner dispensers.

4. The apparatus of claim 2, wherein the toner dispenser member is also a toner mixing member which mixes the toner in the toner dispensers.

5. The apparatus of claim 1, further comprises:

a gating member associated with the at least two toner dispensers, the gating member having at least two toner gating sections, each gating section having a toner dispenser associated therewith, wherein the gating member moves from an open to a closed position; the open position allowing toner to flow through the opening and the closed position blocking toner flow through the opening; and a gate controller for controlling the gating member.

6. A method for dispensing toner, comprising:

locating at least two toner dispensers in close proximity to one another, each toner dispenser having a supply of toner contained therein and an opening through which toner passes from the toner dispenser;

dispensing toner from the at least two toner dispensers with a toner dispenser member having at least two toner dispenser sections, each toner dispenser section having a toner dispenser associated therewith and moving toner in the toner dispensers with the toner dispenser member extending between the toner dispensers which moves toner in the toner dispensers towards the openings through which toner passes from the toner dispenser; and controlling dispensing with a toner dispenser member control.

7. The method as claimed in claim 6, wherein locating the at least two toner dispensers includes integrally forming the toner dispensers such that each toner dispenser shares a common wall with another toner dispenser.

8. The method as claimed in claim 7, further comprising:

sealing portions of the toner dispenser member which extend through the common walls between the toner dispensers.

9. The method of claim 6, wherein dispensing toner includes:

mixing the toner with the toner dispenser member.

10. The method of claim 6, further comprising:

gating a flow of toner from the toner dispensers with a gating member associated with the at least two toner dispensers, the gating member moving from an open to a closed position; the open position allowing toner to flow through the opening and the closed position blocking toner flow through the opening.

11. The method of claim 6, wherein dispensing the toner includes:

mixing the toner with the toner dispenser member.

12. An apparatus for dispensing toner, comprising:

at least two toner dispensers, each toner dispenser having a supply of toner contained therein and an opening through which toner passes from the toner dispenser;

a toner dispenser member associated with the toner dispensers, the toner dispenser member having at least two toner dispenser sections, each toner dispenser section having a toner dispenser associated therewith and the toner dispenser member is a toner mixing member extending between the toner dispensers which mixes the toner in the toner dispensers; and a toner dispenser member control for controlling movement of the toner dispenser member.

13. An apparatus for dispensing toner, comprising:

at least two toner dispensers, each toner dispenser having a supply of toner contained therein and an opening through which toner passes from the toner dispenser;

a toner dispenser member associated with the toner dispensers, the toner dispenser member having at least two toner dispenser sections, each toner dispenser section having a toner dispenser associated therewith and is a gating member which controls the flow of toner through the openings in the toner dispenser; and a toner dispenser member control for controlling movement of the toner dispenser member.

14. The apparatus of claim 13, the toner dispenser member further comprises:

gating member openings which when aligned with the openings in the toner dispensers, allow toner to flow from the toner dispensers.

15. The apparatus of claim 13, further comprising:

tracks for the gating member to move along, wherein the toner dispenser member control can selectively control the alignment of the toner dispenser openings and the gating member openings.

16. A method for dispensing toner, comprising:

locating at least two toner dispensers in close proximity to one another, each toner dispenser having a supply of toner contained therein and an opening through which toner passes from the toner dispenser;

dispensing toner from the at least two toner dispensers with a toner dispenser member having at least two toner dispenser sections, each toner dispenser section having a toner dispenser associated therewith and gating a flow of toner with the toner dispenser member; and controlling dispensing with a toner dispenser member control.

17. The method of claim 16, wherein gating the flow of toner includes:

aligning openings in the toner dispenser member with openings in the toner dispensers when toner is to flow from the toner dispenser; and misaligning openings in the toner dispenser member with the openings in the toner dispensers when the flow of toner is to be stopped.

18. The method of claim 17, wherein the dispensing controlling includes:

moving the toner dispenser member along a track to selectively align the openings in the toner dispenser with the openings in the toner dispenser member.

* * * * *